United States Patent [19]

Seyfried et al.

[11] 3,986,448

[45] Oct. 19, 1976

[54] SIMPLIFIED ROLLING BOLSTER SYSTEM FOR PRESS

[75] Inventors: Donald N. Seyfried, New Bremen; Kenneth E. Olding, Hamilton, both of Ohio

[73] Assignee: The Minster Machine Company, Minster, Ohio

[22] Filed: Jan. 27, 1975

[21] Appl. No.: 544,237

[52] U.S. Cl. ..... 100/229 R; 72/448; 100/DIG. 18

[51] Int. Cl.[2] ..... B30B 15/06

[58] Field of Search ..... 100/DIG. 18, 229 R, 100/221, 224; 72/446, 448; 83/698, 700

[56] References Cited

UNITED STATES PATENTS

| | | | |
|---|---|---|---|
| 2,988,234 | 6/1961 | Barothy et al. | 100/DIG. 18 |
| 2,996,025 | 8/1961 | Georgeff | 72/446 |
| 3,002,479 | 10/1961 | Johansen et al. | 100/DIG. 18 |
| 3,134,350 | 5/1964 | Danly et al. | 100/DIG. 18 |
| 3,229,791 | 1/1966 | Soman | 100/DIG. 18 |
| 3,368,479 | 2/1968 | Gregorovich | 100/229 R |
| 3,422,660 | 1/1969 | Countess et al. | 72/448 |

*Primary Examiner*—Billy J. Wilhite

*Attorney, Agent, or Firm*—Albert L. Jeffers; Roger M. Rickert

[57] ABSTRACT

A rolling bolster system for a press in which the press has a press frame with a bed. The press frame is provided with at least one side opening for access to the press bed. Tracks in the form of grooves are formed in the top of the press bed and further tracks are provided externally of the press bed aligned with the tracks on the bed. The tracks engage support rollers provided on a bolster which can be rolled on the tracks into working position in the press frame and rolled out of the press frame for access to die members mounted on the bolster. When the bolster is rolled into the press frame, track sections provided in the tracks formed in the press bed are lowered, thereby setting the bolster down directly on the press bed and in which position the bolster can be fixedly secured to the press bed.

The vertically movable sections of the track formed in the press bed are adjustable between upper positions of alignment with the tracks and lower positions in which the bolster is set down on the press bed.

5 Claims, 7 Drawing Figures

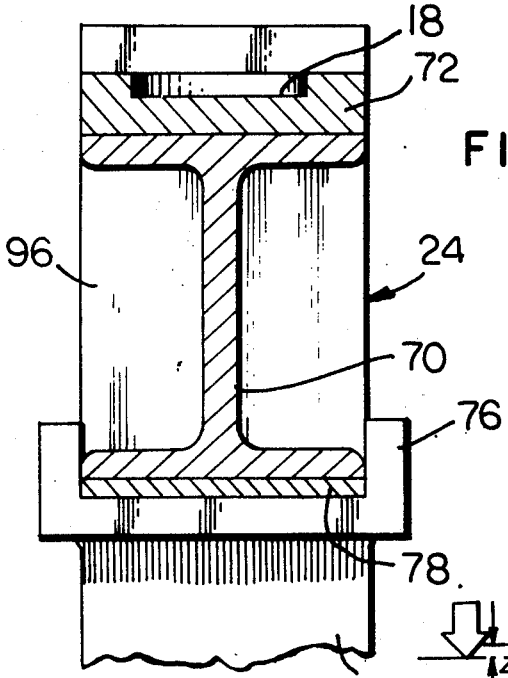
FIG. 2
FIG. 4
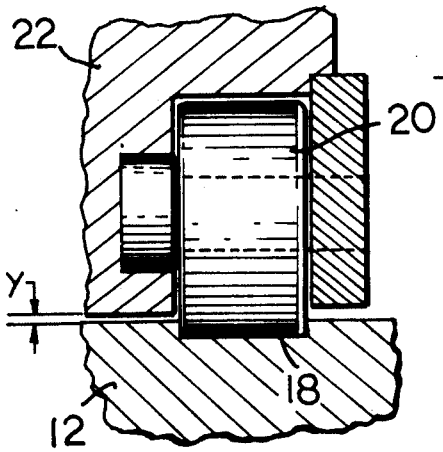
FIG. 5
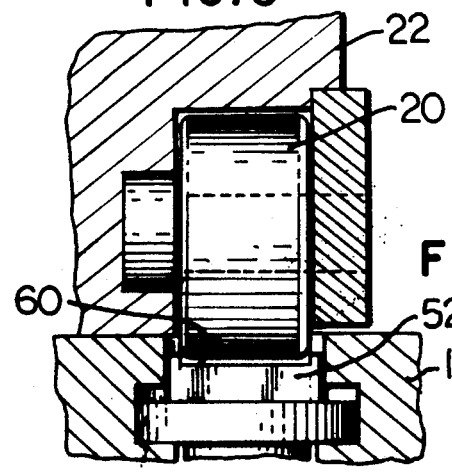
FIG. 6
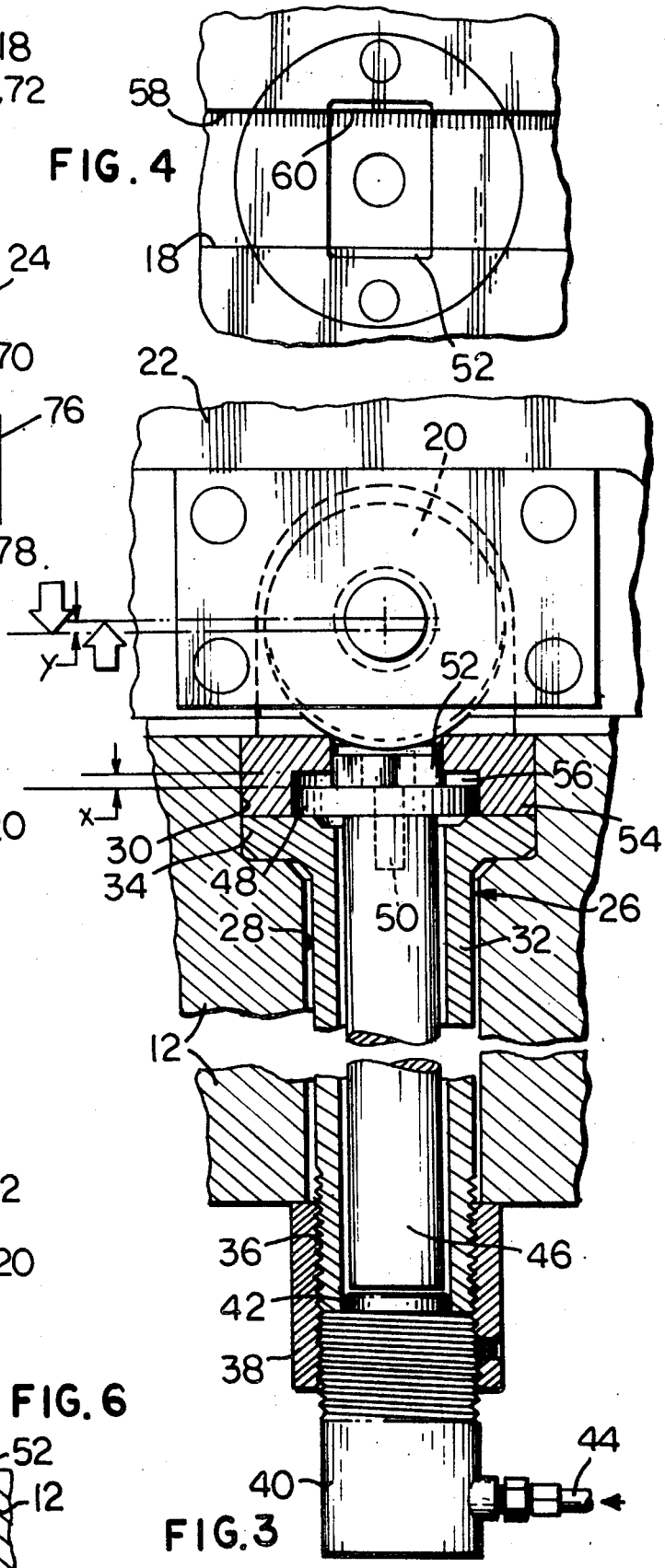
FIG. 3

SIMPLIFIED ROLLING BOLSTER SYSTEM FOR PRESS

The present invention relates to a simplified rolling bolster system for a press and is particularly concerned with such a system in which the bolster is a simple block-like member provided with rollers, while the raising and lowering of the bolster when it is in the press is accomplished by a mechanism included in its entirety within the press frame.

Rolling bolsters for presses are well known and are widely used. Known rolling bolster arrangements are shown, for example, in Gregorovich U.S. Pat. No. 3,368,479, and in certain ones of the references cited therein. Known rolling bolster arrangements according to the prior art, however, have involved complexities and expensive constructions which have added considerably to the cost of construction and the difficulty and cost of maintenance of the systems. For example, in the rolling bolster arrangement of the Gregorovich patent above referred to, the bolster is provided with wheels that are vertically movable on the bolster by actuating devices contained within the bolster. The function of the movable wheels is to raise and lower the bolsters between elevated rolling positions and lowered positions in which the bolster is set down firmly on the press bed. The inclusion of the mechanism for raising and lowering the bolster within the bolster introduces considerable expense and complications in the system.

Other rolling bolster arrangements according to the prior art are similarly complex and expensive.

With the foregoing in mind, it is a particular object of the present invention to provide the rolling bolster system for a press which is greatly simplified over what has been disclosed in the prior art.

Another object is the provision of a rolling bolster system for presses which is inexpensive to apply to a press.

A still further object of the present invention is the provision of a rolling bolster system for a press in which all of the movable actuating elements for the system are embodied within the press frame itself, thereby permitting the bolster to be of extremely simple construction.

Another object of the present invention is the provision of a simple and accessiible actuating mechanism with all of the movable actuating elements operated from a single common location.

BRIEF SUMMARY OF THE INVENTION

According to the present invention, a press frame is provided and which frame includes a horizontal bed region and at least one side opening for access to the bed. The bed is provided with spaced parallel grooves extending thereacross from the opening and forming tracks for supportingly engaging rollers carried by a bolster member. Further tracks are provided externally of the press and are aligned with the tracks on the press bed. The further tracks are advantageously members which are fixedly connected to the press frame at one end and which are provided with support members adjacent the other end for supporting the further tracks on the press room floor.

A rolling bolster or die is provided which is a simple block member provided with rollers protruding therefrom on opposite ends and which rollingly engage the tracks on the outside of the press frame and also the tracks formed on the press bed.

The bolster can readily be moved into and out of the press frame by rolling it on the aforementioned tracks. When the bolster is moved into the press frame into working position within the press frame, sections of the track formed on the press bed can be lowered. These sections are disposed directly beneath the rollers on the bolster and, when lowered, lower the bolster downwardly until it sets directly on the press bed. With the bolster so lowered to the press bed, the bolster can be fixedly connected to the press bed, as by bolts or other clamping means, and a die set, previously secured to the bolster when the bolster was outside the press, can now have the upper part connected to the press platen and working operations can now be commenced.

The vertically movable track sections in the tracks formed in the press bed are inserted into bores formed in the press bed and are secured in place in the press bed, and may be actuated by hydraulic actuators, such as hydraulic cylinder-piston arragements on the underneath side of the press bed. Power can be supplied to the cylinder-piston arrangements in any desired manner as by a motor driven pump or by a hand operated pump.

When the track sections referred to are elevated by energizing the power means, the track sections align with the tracks on the press bed and the bolster is supported in spaced relation to the bed and can easily be rolled along the tracks.

When the power means is reversed, however, the track sections lower and the bolster is set down firmly on the press bed. In the aforementioned manner, an extremely simple construction permits all of the advantages of a rolling bolster system for a press to be realized without, at the same time, providing complicated expensive special bolster constructions and control systems therefor.

The exact nature of the present invention and the several objects and advantages thereof will become more apparent upon reference to the following detailed specification taken in connection with the accompanying drawings, in which:

FIG. 2 is a vertical transverse section indicated by line 2—2 on FIG. 1, and showing the appearance of the track outside the press frame in cross section.

FIG. 3 is a vertical sectional view indicated by line 3—3 on FIG. 1, and showing more in detail the construction of one of the vertically movable track sections formed in the track on the press bed.

FIG. 4 is a plan view looking down on top of FIG. 3.

FIG. 5 is a view showing a roller on the bolster in a region of the track on the press bed and with the bolster in spaced relation to the press bed.

FIG. 6 is a view like FIG. 2, but shows the roller of the press bed disposed over a movable track section and with the track section lowered so that the bolster rests directly on the press bed.

DETAILED DESCRIPTION OF THE INVENTION

Figures 1, 7:
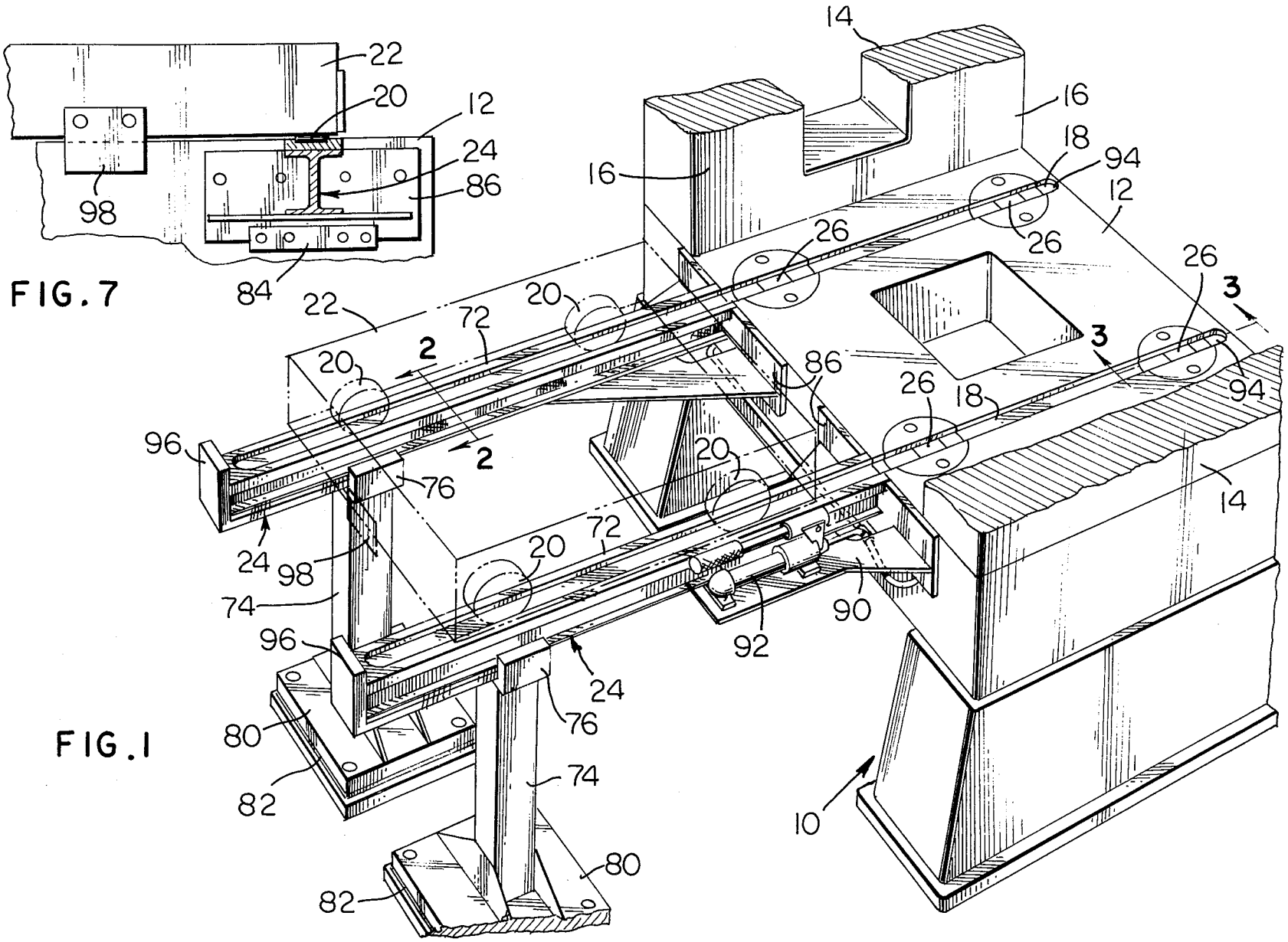
FIG. 1 is a somewhat schematic perspective view showing a simplified rolling bolster system according to the present invention.
FIG. 7 is a fragmentary view showing the manner in which the end of the external track is secured to the press bed in position to register accurately with the track on the press bed.

Referring to the drawings somewhat more in detail, in FIG. 1 a press is schematically indicated by reference numeral 10. What is shown of the press is the lowermost part consisting of the bed 12 and the uprights 14 which extend upwardly from opposite sides of the bed and which at the top are connected to the press crown which contains the mechanism for actuating the press slide which is reciprocable in vertical direction toward and away from the bed 12.

As will be seen, the press frame includes front and back openings 16 which provide for access to the bed. The bed 12 on the upper side is provided with spaced parallel grooves 18 extending across the bed from one of the openings 16 and forming first track means on top of the bed for engagement with rollers 20 which are provided on a bolster member 22. The rollers 20 protrude downwardly below the bolster member 22 a short distance as will be seen hereinafter.

Externally of the press frame there is provided a pair of grooved track members 24, the grooves of which form second track means which register with the track means on the press bed which are formed by the aforementioned grooves 18. As will be seen in FIG. 1, the grooved track members 24 also supportingly engage rollers 20 of bolster member 22.

A particular feature of the present invention is to be found in the provision of sections of the first track means formed on the press bed which can be moved in the vertical direction to lift bolster member 22 from the press bed and to set bolster member 22 down on the press bed. Movable track sections of the first track means on the press bed are indicated at 26 and a typical one thereof is shown in vertical section in FIG. 3 and in plan view in FIG. 4.

In FIGS. 3 and 4 it will be noted that the press bed 12 is provided with a vertical hole 28 for each of the movable track sections and each of which vertical holes is counterbored at the top as at 30. Disposed within each hole 28 is a sleeve member 32 having a flange 34 at the upper end receivable in the respective counterbore 30 and engaging the bottom of the counterbore. The lower end of sleeve 32 protrudes downwardly below the bottom of bed 12 and has a threaded portion 36 thereon. A nut 38 is threaded on portion 36 thereby clamping sleeve 32 in place, while at the bottom of nut 38 there is threadedly mounted a cylinder-piston hydraulic actuator 40, and the ram 42 of which is vertically movable inside sleeve 32 under the influence of hydraulic fluid supplied to the cylinder by conduit 44.

A push rod member 46 is provided inside sleeve 32 and at the bottom terminates in slightly spaced relationship to the upper end of ram 42 when the latter is in its lower, or retracted, position. At the upper end rod 46 has connected thereto a flanged member 48 held in place, for example, by a cap screw 50. The upper side of flanged member 48 has an upwardly extending rectangular projection 52 thereon.

The flanged member 48 and the projection 52 thereon are enclosed within a cap 54 secured to the upper side of flange 34. The flange member 48 is movable within a recess 56 provided in the underside of cap 54 with the recess being of such a depth that the direction of movement of the flanged member in at least the upward direction is accurately limited.

As will be seen in FIGS. 3 and 4, the cap 54 is provided with a groove 58 which forms a continuation of the groove 18 in the bed. Similarly, projection 52 which, in the side-to-side direction is longer than the width of grooves 18 and 58, is itself provided with a groove 60. When the rod 46 and flanged member 48 are in the uppermost position thereof, the upwardly facing surfaces of grooves 18 and 58 and 60 are all in exact alignment so that the track means across the bed is smooth and no obstruction is offered to movement of the rollers of a bolster is moved into and out of the press. It will be noted that flanged member 48 abuts the bottom of the recess 56 in cap 54 when the flanged member is in the lowermost position thereof.

However, as will be seen in FIG. 3, when ram 42 is in its lower, or retracted, position and push rod 46 and flanged member 48 are lowered until the flanged member rests on the flange 34 of the upper end of sleeve 32, the upwardly protruding rectangular portion 52 on top of the flanged member is lowered downwardly until the bolster member 22 rests directly on the upper surface of bed 12. The roller 20 at that time protrudes downwardly into the central hole in cap 54 a short distance but is, as will be seen, at least slightly spaced from the upwardly facing surface of groove 60 in the top of projection 52 of flanged member 48.

As will be seen in FIG. 3, the distance travelled by the bolster between its elevated rolling position and its lowered position wherein it rests directly on the press bed is indicated by the dimension Y, whereas the amount of travel of flanged member 48 between its upper position and its lower position is indicated by dimension X and which is greater than the dimension Y.

The bolster member 22 in rolling position is illustrated in FIG. 5 and wherein the roller 20 on the bottom thereof is engaging track or groove 18 formed in the top of bed member 12. It will be noted at this time that the bottom surface of the bolster member is spaced from the top of the press bed 12 a distance indicated by Y.

In FIG. 6, the bolster member 22 is shown resting on top of bed 12 and at this time the roller 20 on the bottom of the bolster member protrudes downwardly into the space within which upper portion 52 of the flanged element is vertically movable.

With reference to the track members 24 on the outside of the bed, each of these may comprise an I-beam 70, as shown in FIG. 2, having mounted on top thereof a grooved track element 72. The bottom of the external track members 24 in the regions spaced from the bed are engaged by the upper ends of respective support members 74 with flanges 76 on the sides thereof confining the respective track member 24 against lateral movement. The support members 74 have base portions 80 thereon at the bottom for engagement with the press room floor and shims 82 can be provided therebeneath, if necessary, to adjust the support members vertically.

At the bed end of the external track members, the track members are connected directly to the bed. For accomplishing this connection, the bed member may have keys 84 affixed thereto and which are employed for locating support plate members 86 which may be welded to the ends of the track members 24.

At least one of the track members at the bed end may be provided with a support plate 90 on which is mounted a manually operable fluid pump 92 which is connected to the several conduits 44. Pump 92 is operable for supplying fluid under pressure for lifting the respective rams of the cylinder-piston actuators vertically upwardly. The manually operable pump 92 also includes means for exhausting the fluid from the cylinders 40 to permit the rams 42 to move downwardly therein and permit the track sections to lower.

Advantageously, the bolster member 22 can have one or more stop plates 98 connected thereto which engage the side of the bed facing the external tracks when the bolster member is moved into working position, or which may be provided for the purpose of preventing the bolster member from being moved too far.

Similarly, the external track members 24 preferably have upstanding abutments 96 at the outer ends which will prevent the bolster member from being pushed too far in the outward direction.

Alternatively grooved track elements 72 may be located at both sides of the press bed 12, permitting the rolling bolster to be moved from the press bed area in either of two directions by omitting closed ends 94 in tracks 18.

To accomplish lateral positioning of the bolster one of the track sections 18 and one of the track sections 72 in line with it are provided with grooves that closely fit the width of the rollers 20 that operate in the grooves. It is permissible, but not mandatory, to make the grooves in the second track sections 18 and 72 wider than the corresponding rollers to minimize dimensional problems.

Modifications may be made within the scope of the appended claims.

What is claimed is:

1. In a press having a press frame with a horizontal bed and a side opening providing access to said bed; first track means extending across the bed from the said opening, second track means outside the frame forming a continuation of the first track means, said track means adapted to engage rollers carried by a bolster for rollingly supporting the bolster during movement thereof through the frame opening into and out of working position on the press bed, said first track means including vertically movable track sections over which the rollers rest when the bolster is in working position, said bed includes vertical holes therein intersecting said first track means, a vertical sleeve fixed in each respective hole, said track sections comprising a push rod vertically movable in each sleeve, cylinder means connected to one end of said sleeve including a ram for moving said sections to a predetermined upper position of alignment with said track means, and abutment means including a stationary member attached to the bed and cooperating with an abutment member carried by the push rod to limit the upward travel of said push rod to establish said predetermined upper position.

2. A press according to claim 1 in which the upper end of each sleeve includes a member having a groove extending thereacross and coplanar with the respective first track means in the bed, each push rod being non-rotatable in the respective sleeve and also having a groove extending thereacross which is coplanar with the respective first track means in the bed in the upper position of said push rod.

3. A press according to claim 1 in which each hole is counterbored, each sleeve having a flange at the upper end in the respective counterbore, and a nut threaded on the lower end of each sleeve beneath the bed.

4. A press according to claim 1 in which each hole is counterbored from the top, each sleeve having a flange at the upper end in the respective counterbore, a cap on the upper end of each sleeve having a recess formed into the bottom and at the top being substantially flush with the top of said bed, said push rod having a flange portion in said recess and a rectangular portion upstanding from the flange portion, said cap having a rectangular hole to receive said rectangular portion, said cap having a groove thereacross which aligns with the respective first track means in the bed and is coplanar therewith, said rectangular portion also having a groove thereacross which is in coplanar registration with the groove in the cap when the rectangular portion is in the position in which said flange portion abuts the bottom of the recess in the respective cap.

5. A press according to claim 4 in which the first track means in the bed on one side and in the grooves in the caps and in said rectangular portions on that same side are all the same width.

* * * * *